US010260534B2

(12) United States Patent
Sefcik et al.

(10) Patent No.: US 10,260,534 B2
(45) Date of Patent: Apr. 16, 2019

(54) HYDRAULIC FLOWPATH THROUGH A CYLINDER WALL

(71) Applicant: Caterpillar Inc., Peoria, IL (US)

(72) Inventors: Edwin Sefcik, Elm Mott, TX (US); Johannes Lambertus Leonardes van Gemert, Mill (NL)

(73) Assignee: Caterpillar Inc., Deerfield, IL (US)

( * ) Notice: Subject to any disclaimer, the term of this patent is extended or adjusted under 35 U.S.C. 154(b) by 269 days.

(21) Appl. No.: 15/347,224

(22) Filed: Nov. 9, 2016

(65) Prior Publication Data

US 2018/0128291 A1 May 10, 2018

(51) Int. Cl.
*F15B 15/14* (2006.01)

(52) U.S. Cl.
CPC ..... *F15B 15/149* (2013.01); *F15B 15/1428* (2013.01); *F15B 15/1433* (2013.01)

(58) Field of Classification Search
CPC ..... F15B 15/149; F15B 15/1428; F15B 15/1433; F15B 15/1438; F15B 15/14; F02B 61/045; F01B 31/12; F16J 15/18
USPC ..... 92/171.1, 133, 113, 163
See application file for complete search history.

(56) References Cited

U.S. PATENT DOCUMENTS 2,134,227 A * 10/1938 Forkardt ..... B23B 31/302 269/25
2,761,425 A * 9/1956 Bertsch ..... B62D 5/062 138/114
3,511,136 A * 5/1970 Thomas ..... B23Q 3/08 92/161
3,929,057 A 12/1975 Kondo
4,050,359 A * 9/1977 Mayer ..... B63H 20/10 91/422
4,052,952 A * 10/1977 Hale ..... F02B 61/045 248/642
4,791,726 A * 12/1988 Ailey, Jr. ..... A22C 21/063 30/180
4,825,752 A * 5/1989 Kiffmeyer ..... F15B 15/225 91/419
4,860,638 A * 8/1989 Hosono ..... F16L 37/56 91/536
4,907,495 A 3/1990 Sugahara
4,976,639 A * 12/1990 Rawlings ..... B63H 21/265 440/59
5,350,326 A * 9/1994 Funami ..... B63H 21/265 114/144 E
5,387,142 A * 2/1995 Takayanagi ..... B63H 21/265 114/144 R (Continued)

FOREIGN PATENT DOCUMENTS

CN 203685751 U 7/2014
CN 103511389 B 7/2015

*Primary Examiner* — Thomas E Lazo
*Assistant Examiner* — Richard C Drake
(74) *Attorney, Agent, or Firm* — Law Office of Kurt J. Fugman LLC

(57) ABSTRACT

Various embodiments of a hydraulic cylinder assembly, cylinder liner member and a hydraulic manifold for use with the hydraulic cylinder assembly reduce the need for external plumbing from the rear of the hydraulic cylinder assembly to the front of the hydraulic cylinder assembly. The cylinder liner member may include three bores that convey fluid from the manifold from the rear of the hydraulic cylinder assembly to the front of the assembly, conveying fluid to the retract volume of the cylinder.

2 Claims, 10 Drawing Sheets

(56) References Cited

U.S. PATENT DOCUMENTS

| | | | | | |
|---|---|---|---|---|---|
| 5,427,045 | A * | 6/1995 | Fetchko | B63H 25/30 | 114/150 |
| 5,928,041 | A * | 7/1999 | Anderson | B63H 21/265 | 114/150 |
| 5,975,968 | A * | 11/1999 | Nakamura | B63H 20/10 | 440/56 |
| 6,042,435 | A * | 3/2000 | Nakamura | B63H 20/10 | 440/61 D |
| 6,044,752 | A * | 4/2000 | Harigaya | F15B 15/1428 | 92/163 |
| 6,058,826 | A * | 5/2000 | Dietrich | B62D 5/12 | 60/406 |
| 6,186,043 | B1 | 2/2001 | Deere | | |
| 6,328,616 | B1 * | 12/2001 | Nakamura | B63H 20/10 | 440/61 D |
| 6,519,939 | B1 * | 2/2003 | Duff | F15B 1/265 | 60/473 |
| 7,637,102 | B2 * | 12/2009 | Gest | F15B 11/0445 | 60/394 |
| 8,015,913 | B2 * | 9/2011 | Kriegsmann | F15B 15/1428 | 92/163 |
| 2009/0084257 | A1 * | 4/2009 | Buckley | F15B 15/222 | 91/403 |
| 2009/0090239 | A1 * | 4/2009 | Trevisan | F15B 15/065 | 92/5 R |
| 2011/0049400 | A1 * | 3/2011 | ter Horst | F15B 15/065 | 251/25 |
| 2013/0255479 | A1 * | 10/2013 | Liu | F15B 15/202 | 91/346 |
| 2015/0300381 | A1 * | 10/2015 | Pozzo | E02F 9/2267 | 137/1 |

* cited by examiner

HYDRAULIC FLOWPATH THROUGH A CYLINDER WALL

TECHNICAL FIELD

The present disclosure relates to hydraulic cylinders. More particularly, the present disclosure is related to a hydraulic cylinder that limits the use of external plumbing such as hoses or rigid tubing to convey a working fluid to the extend and retract sides of a cylinder piston.

BACKGROUND

In hydraulic cylinders, the working fluid such as hydraulic oil needs to be conveyed to both the extend side and retract side of the cylinder piston in order to make a cylinder rod, which is connected to the cylinder piston, move back and forth. Often, these hydraulic cylinders are used on earth moving, construction, mining and other similar types of equipment. If external plumbing is employed to convey the fluid to either side of the piston, there is a risk that the hose or tubing may be damaged if the plumbing hits an obstacle or the like, damaging the plumbing. This can cause a leak rendering the cylinder ineffective for its intended purpose.

One example of such a cylinder is disclosed in FIG. 1 in U.S. Pat. No. 6,186,043 to Callies. In the '043 patent, hydraulic fittings with metering orifices are provided on top of the cylinder that communicate with radially extending bores that communicate with the extend volume and retract volume on either side of the cylinder piston. Though not shown, tubing, hose or other form of external plumbing is typically used to communicate the fluid to these fittings. As can be imagined, such external plumbing may be prone to damage during use rendering the cylinder ineffective.

Accordingly, a solution that limits the need to use external plumbing to convey the working fluid to either side of the cylinder piston is desirable.

SUMMARY OF THE DISCLOSURE

A hydraulic cylinder assembly is provided comprising a cylinder liner defining a generally annular cylindrical wall defining a cylindrical axis and a radial direction, the liner also defining a first enclosed end and a second open end disposed along the cylindrical axis and an interior space. A hydraulic manifold is attached to the cylinder liner proximate the first enclosed end and a head cap is attached to the second open end of the cylinder liner. The head cap defines a hole and a cylinder rod extends through the hole of the head cap, the cylinder rod including an exposed end and an encapsulated end. A cylinder piston is attached to the encapsulated end of the cylinder rod inside of the interior space of the cylinder liner, dividing the space into an extend volume on one side of the piston nearest the enclosed end and a retract volume nearest the open end. The hydraulic manifold defines at least a first channel that communicates with the extend volume and at least a second channel that communicates with the retract volume and the cylinder liner defines a first axially extending bore, a second bore extending at least partially radially, and a third bore extending at least partially radially, the first axially extending bore, the second bore extending at least partially radially, and the third bore extending at least partially radially being in communication with the at least second channel of the hydraulic manifold.

A cylinder liner member is provided comprising a generally cylindrical annular wall defining a cylindrical axis, a radial direction, a circumferential direction, a first end and a second end disposed along the cylindrical axis defining a length therebetween, and an interior space partially enclosed by the wall and extending from the first end to a second end, forming first and second openings at the first and second ends respectively. The wall defines and a first axially extending bore that extends from either the first end or the second end along most of the length of the cylinder liner member, a second bore extending at least partially radially, and a third bore extending at least partially radially. The first, second and third bores are in communication with each other and the first bore extends from an outer cylindrical surface of the wall and intersects the first bore and the third bore extends from an inner cylindrical surface of the wall and intersects the first bore.

A hydraulic manifold assembly is provided comprising at least a main member defining a top surface, a bottom surface and a thickness between the top surface and the bottom surface being the minimum dimension of the main member. The main member further defines a first plurality of channels including a first channel extending in a direction perpendicular to the thickness of the main member and a second channel in communication with the first channel extending in a direction parallel to the thickness. The main member further defines a second plurality of channels including a third channel extending in a direction perpendicular to the thickness of the main member and a fourth channel extending in a direction parallel to the thickness. The first and second plurality of channels are not in communication with each other and are spaced apart from each other along a direction that is perpendicular to the thickness of the main member.

DETAILED DESCRIPTION

Figure 1:
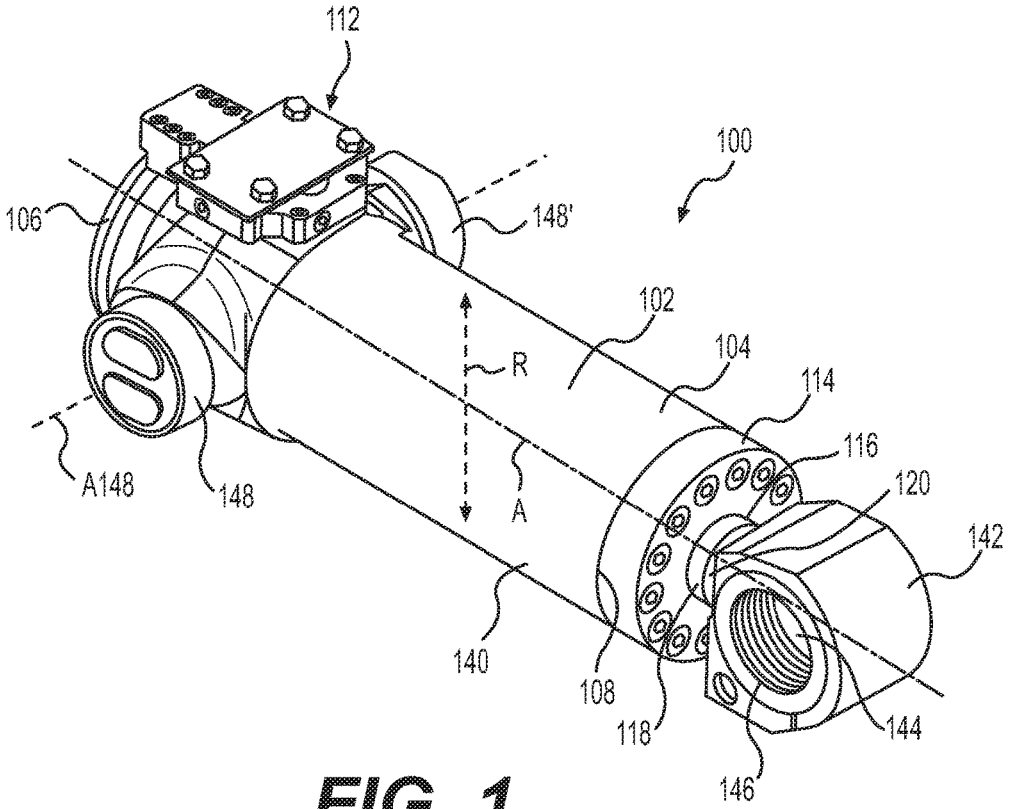
FIG. 1 is a perspective view of a hydraulic cylinder assembly according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides various embodiments of a hydraulic cylinder assembly, cylinder liner member and hydraulic manifold assembly that may reduce the need for external plumbing to provide working fluid to the extend volume and retract volume of a hydraulic cylinder on either side of the piston. This may reduce the risk of damaging such external plumbing. The passages for conveying the fluid may be formed using casting, machining, 3D printing or the like, and assembling various components to make subassemblies and assemblies, etc. These passages may extend from the rear cap or rear end of the hydraulic cylinder assembly to the retract port positioned at the head end of the hydraulic cylinder assembly, etc. Any suitable working fluid may be used with any of the embodiments disclosed herein including, but not limited to, oil, air, hydraulic fluid, fuel, etc.

Figure 2:
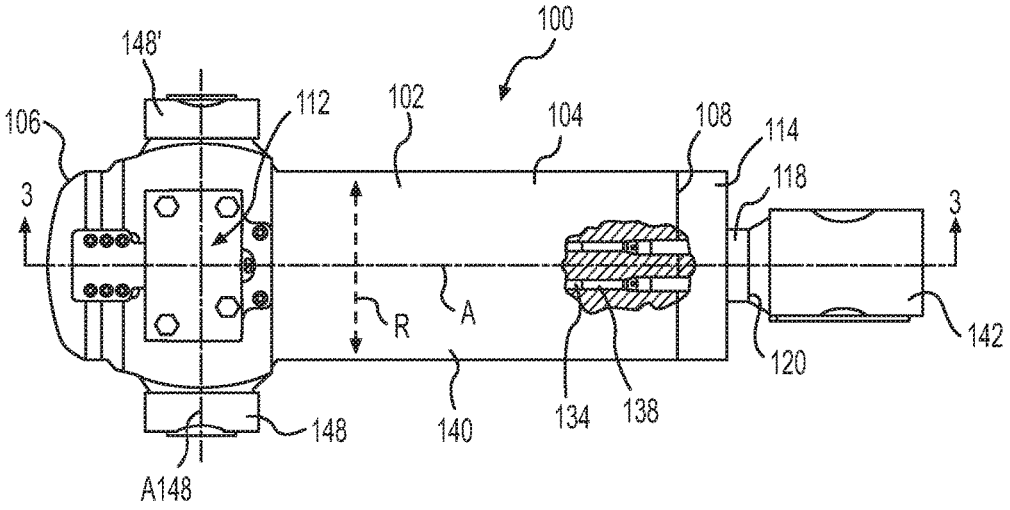
FIG. 2 is top view of the hydraulic cylinder of FIG. 1 with the top of the cylinder liner partially cut away, revealing axially extending fluid bores.
Figure 3:
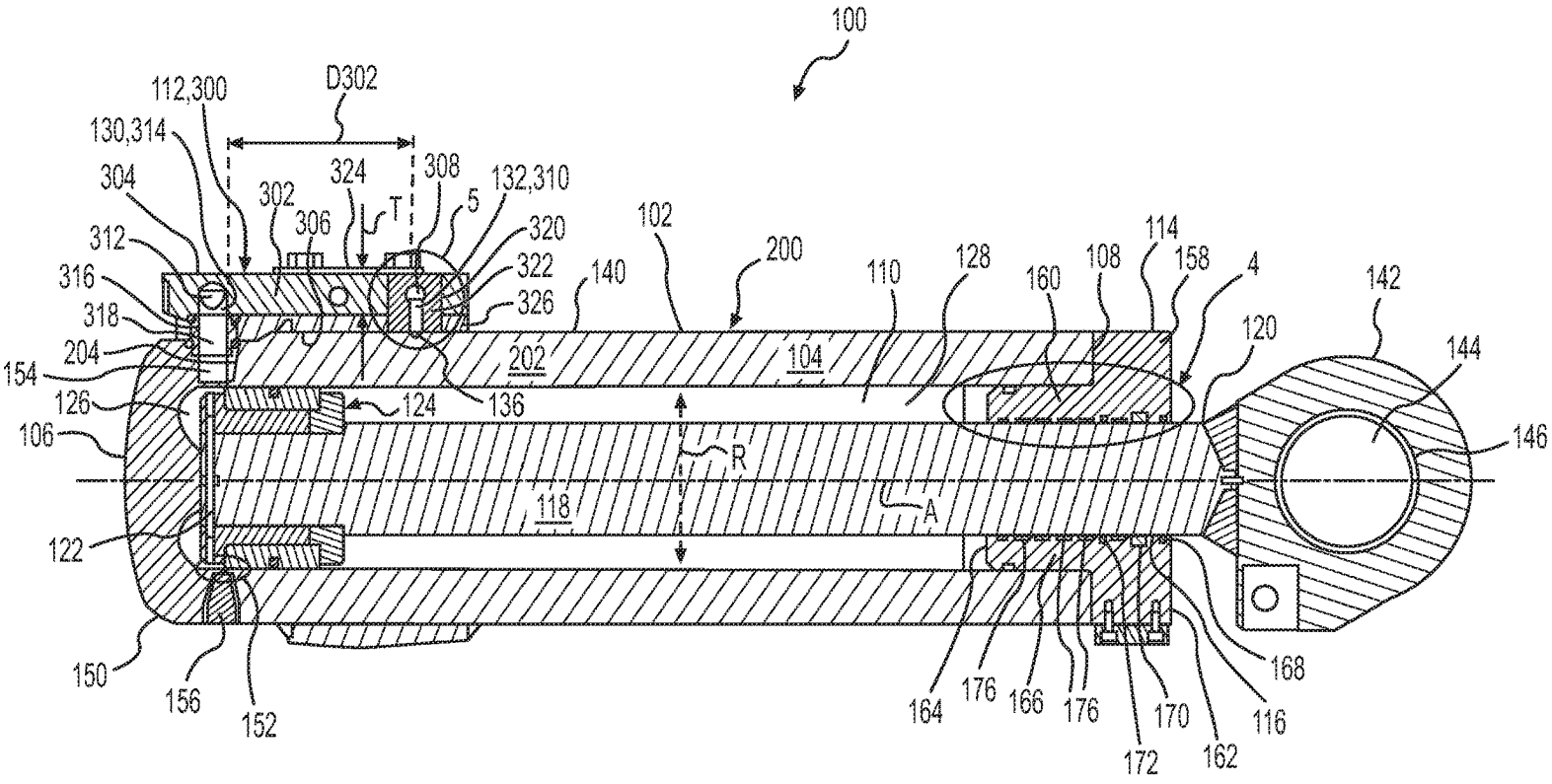
FIG. 3 is a cross-sectional view of the hydraulic cylinder of FIG. 2 taken along lines 2-2 thereof.

Looking at FIG. 1 thru 3, a hydraulic cylinder assembly 100 according to an embodiment of the present disclosure is shown. The assembly 100 may comprise a cylinder liner 102 defining a generally annular cylindrical wall 104 defining a cylindrical axis A and a radial direction R. The liner 102 may also defines a first enclosed end 106 and a second open end 108 disposed along the cylindrical axis A and an interior space 110 extending from the second open end 108 to the first enclosed end 106. The assembly 100 may further comprise a hydraulic manifold 112 attached to the cylinder liner 102 proximate the first enclosed end 106 and a head cap 114 attached to the second open end 108 of the cylinder liner 102. The head cap 114 may define a hole 116 and the assembly 100 may also include a cylinder rod 118 extending through the hole 116 of the head cap 114. The cylinder rod 118 may include an exposed end 120 and an encapsulated end 122. The assembly 100 may further include a cylinder piston 124 attached to the encapsulated end 122 of the cylinder rod 118 inside of the interior space 110 of the cylinder liner 102, dividing the space 110 into an extend volume 126 on one side of the piston 124 nearest the enclosed end 106 and a retract volume 128 nearest the open end 108.

The extend volume 126 is so called because the cylinder rod 118 extends from the cylinder liner 102 as the extend volume 126 increases under the action of the working fluid as it enters into the extend volume 126. On the other hand, the retract volume 128 is so called because the cylinder rod 118 is retracted into the cylinder liner 102 as the retract volume 128 increases under the action of the working fluid as it enters into the retract volume 128.

The fluid is supplied to and received from the hydraulic manifold using internal or external plumbing in a manner known in the art. A more detailed description of this is provided later herein. Any method or device known or that will be devised in the art may be used to supply or receive the fluid to and from the hydraulic manifold.

Looking now more closely at the hydraulic manifold 112 as best seen in FIG. 3, it may define at least a first channel 130 that communicates with the extend volume 126 and at least a second channel 132 that communicates with the retract volume 128. As best understood with reference to FIGS. 2, 3, and 8 thru 10, the cylinder liner 102 may also define a first axially extending bore 134, a second bore 136 extending at least partially radially, and a third bore 138 extending at least partially radially. The first axially extending bore 134, the second bore 136 extending at least partially radially, and the third bore 138 extending at least partially radially are in fluid communication with the at least second channel 132 of the hydraulic manifold 112. The at least first channel 130 of the manifold 112 is disposed proximate the enclosed end 106 of the assembly 100 and the at least second channel 132 of the manifold 112 is disposed between the at least first channel 130 and the open end 108 along the cylindrical axis A. For this embodiment, the hydraulic manifold 112 is a separate piece from the cylinder liner 102 and is attached to the outer cylindrical surface 140 of the cylinder liner 102 via welding or fastening, etc. However, it is contemplated that the hydraulic manifold 112 may be integral with the cylinder liner 102 in other embodiments.

Referring back to FIG. 1 thru 3, the assembly 100 may further comprise an eye 142 that is attached to the exposed end 120 of the cylinder rod 118. The eye 142 may define an aperture 144 that is configured to be attached to a component of a machine that is intended to be moved by the hydraulic cylinder assembly 100. In some cases, an internal sleeve bearing 146 is inserted into the aperture 144 of the eye 142 to allow the eye 142 to rotate about the structural member inserted in to the eye 142. Similarly, the assembly 100 may also include a first external sleeve bearing 148 and a second external sleeve bearing 148' attached to the outside surface 140 of the cylinder liner 102 proximate the enclosed end of 106 the cylinder liner 102. Typically as shown, the first and second sleeve bearings 148, 148' face in diametrically opposite directions and are configured to be received in orifices of structural members attached to a machine such that the assembly 100 may rotate about an axis of rotation A148 defined by the external sleeve bearings 148 relative to the machine as the cylinder rod 118 extends and retracts. Examples of such an application will be given later herein.

As best seen in FIG. 3, the cylinder liner 102 comprises a subassembly 200 including a cylinder liner member 202 defining a rear end and a rear cap 150 attached to cylinder liner member 202, forming the enclosed end 106. The assembly 100 further comprises a jointed interface 152 disposed between the rear end 204 of the cylinder liner member 202 and the rear cap 150. The rear cap 150 may define a radially extending bore 154 that is in communication with the at least first channel 130 of the hydraulic manifold 112. The rear cap 150 may be attached to the cylinder liner member 202 using a weld bead 156.

Figure 4:
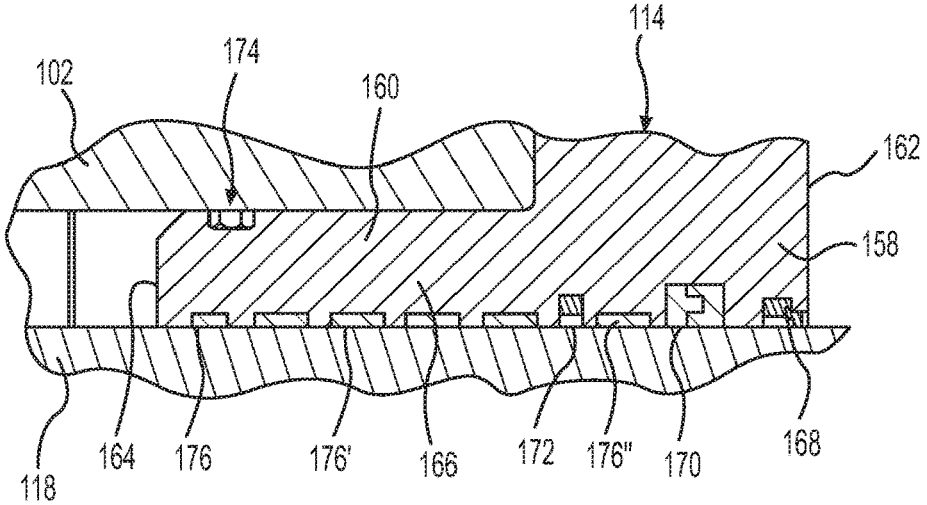
FIG. 4 is an enlarged detail view of the area designated 4 in FIG. 3.
Figure 5:
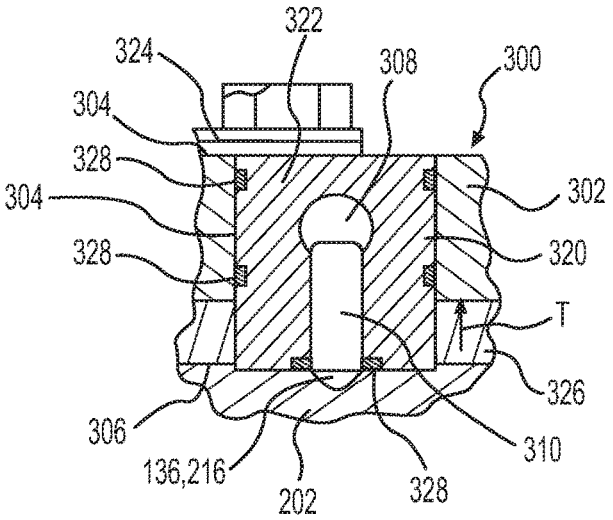
FIG. 5 is an enlarged detail view of the area designated 5 in FIG. 3.
Figure 6:
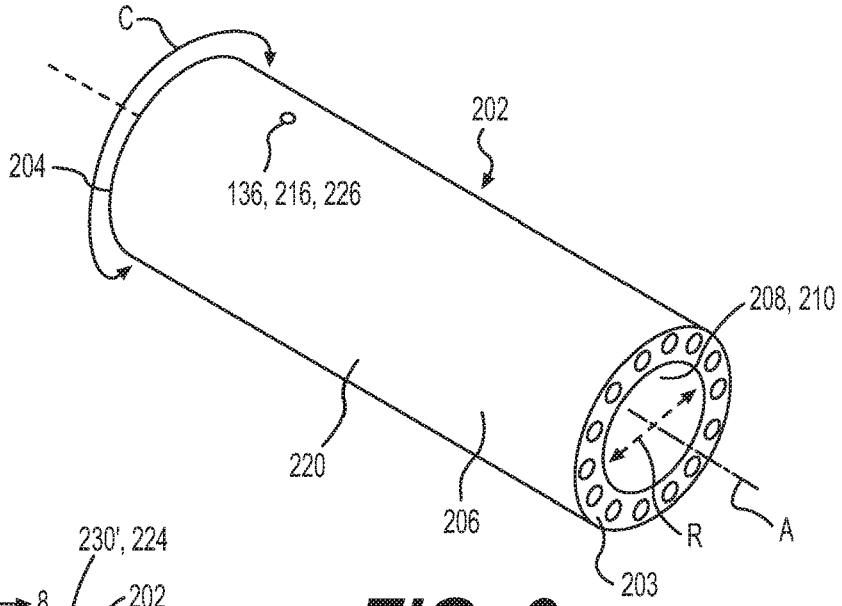
FIG. 6 is a perspective view of the cylinder liner shown in isolation from the assembly of FIG. 1.

As shown in FIGS. 3 and 4, the head cap 114 may comprise a cap portion 158, an inserted portion 160 and a first end 162 and second end 164 disposed along the cylindrical axis A. The head cap 114 may also include a cylindrical wall 166 defining the hole 116 and the cylindrical wall 166 may extend from the first end 162 of the head cap 114 to the second end 164 of the head cap 114. A plurality of seals may be disposed between the cylinder rod 118 and the cylindrical wall 166 of the head cap 114. These seals may include a wiper seal 168, a cup seal 170 and a buffer seal 172 as best seen in FIG. 4 to prevent fluid from leaking out of the cylinder through the seam formed by the head cap 114 and the cylinder rod 118. An outer seal 174 is also provided to prevent fluid form leaking through the seam formed by the cylinder liner 102 and the head cap 114. A plurality of bearing rings 176 may also be placed between the cylinder rod 118 and the cylindrical wall 166 to reduce friction as the cylinder rod 118 slides.

An embodiment of a cylinder liner member 202, in isolation from the hydraulic cylinder assembly 100, will now be described with reference to FIG. 6 thru 12. Initially looking at FIGS. 6, 8 and 9, a cylinder liner member 202 according to an embodiment of the present disclosure may comprise a generally cylindrical annular wall 206 defining a cylindrical axis A, a radial direction R, a circumferential direction C, a first end 203 and a second end 204 disposed along the cylindrical axis A defining a length L202 therebetween, and an interior space 208 partially enclosed by the wall 206 and extending from the first end 203 to a second end 204. Consequently, the interior space 208 forms first and second openings 210, 212 at the first and second ends 203, 204 respectively.

Figure 8:
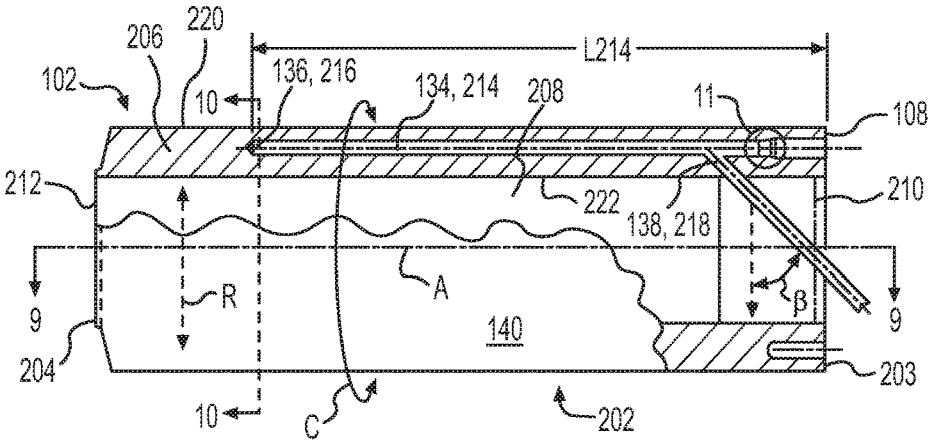
FIG. 8 is a cross-sectional view of the cylinder liner of FIG. 7 taken along lines 8-8 thereof.
Figure 9:
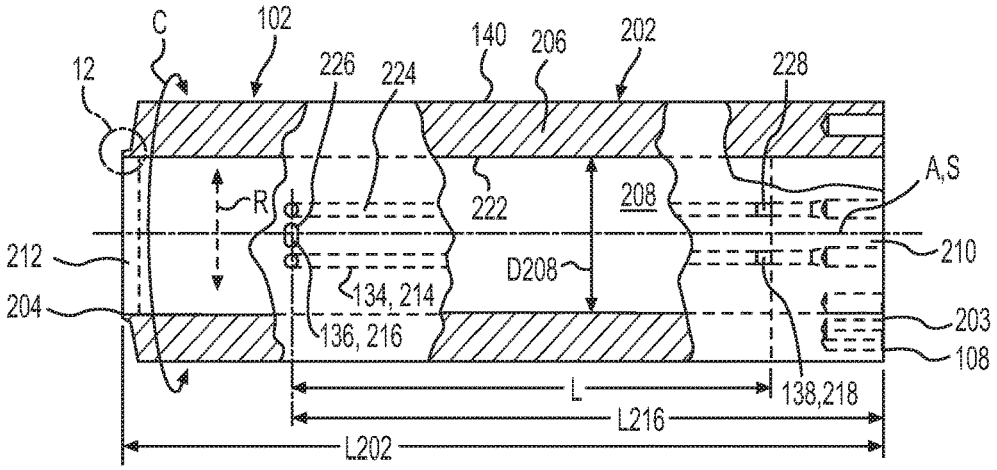
FIG. 9 is a cross-sectional view of the cylinder liner of FIG. 8 taken along liners 9-9 thereof.
Figure 10:
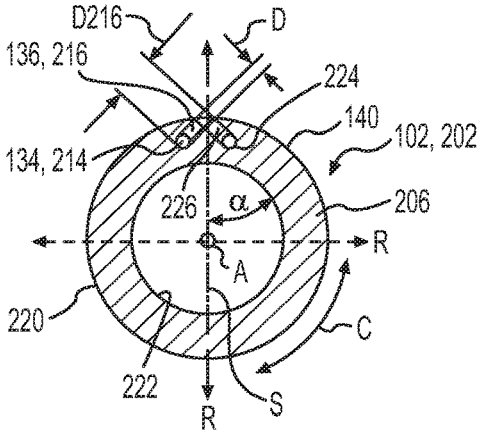
FIG. 10 is another cross-sectional view of the cylinder liner of FIG. 8 taken along lines 10-10 thereof.

As best seen in FIG. 8 thru 10, the wall 206 defines and a first axially extending bore 214 extends from either the first end 203 or the second end 204 but actually extends from the first end 203 in this embodiment. The bore 214 extends along most of the length L202 of the cylinder liner member 202 (see L214 in FIG. 8), a second bore 216 extending at least partially radially, and a third bore 218 extending at least partially radially. The first, second and third bores 214, 216, 218 are in communication with each other and the first bore 214 extends from an outer cylindrical surface 220 of the wall 206 and intersects the first bore 214 and the third bore 218 extends from an inner cylindrical surface of 222 the wall 206 and intersects the first bore 214.

As depicted by FIG. 9, the first intersection of the first bore 214 and the second bore 216 is spaced a predetermined distance L away from the second intersection of the first bore 214 and the third bore 218 along the cylindrical axis A, wherein the distance L is greater than half the length L202 of the cylinder liner member 202. It should also be noted that the distance L216 from the first end 203 to the second bore 216 is slightly less than the depth L214 (shown in FIG. 8) of the first bore to help ensure there is no fluid flow restriction between the first and second bores. Exemplary, non-limiting dimensions for the inner diameter D208 of the interior space 208 and length L202 of the cylinder liner member may be 170-180 mm and 840-860 mm respectively.

Looking now at FIG. 10, it can be seen that the second bore 216 extends both radially and circumferentially. On the other hand, FIG. 8 shows that the third 218 bore extends both radially and axially. The second bore 216 is disposed nearest the second end 204 along the cylindrical axis A and the third bore 218 is disposed nearest the first end 203 along the cylindrical axis A.

Returning to FIG. 10, the wall 206 defines an axial plane (cross-section shown in FIG. 10) and the second bore 216 extends in a direction that forms an angle $\alpha$ in the axial plane with respect to the radial direction R that ranges from 40 to 50 degrees. Conversely, FIG. 8 shows that the wall 206 defines a plane parallel to a radial plane (cross-section shown in FIG. 8) and the third bore 218 extends in a direction that forms an angle $\beta$ in the plane parallel to a radial plane with respect to the radial direction R that ranges from 40 to 50 degrees. In some embodiments, the angles $\alpha$ or $\beta$ may be 45 degrees. It should be noted that for this embodiment the direction the third bore 218 extends intersects the first opening 210. This allows the third bore to be drilled by inserting a drill through the first opening during manufacturing of the cylinder liner member.

As shown in FIG. 10, the diameter D of the second bore may range from 10-20 mm and may be approximately 14-15 mm in some embodiments. A similar diameter may be used for the first and third bores. The depth D216 of the second bore may range from 30-40 mm and may be approximately 37-38 mm in some embodiments.

Any of the dimensions or angles discussed herein for any embodiment may be varied as needed or desired. So, it is to be understood that specific values of dimensions or angles, etc. are given by way of an example and not in a limiting sense in any way.

With continued reference to FIGS. 9 and 10, the cylinder liner member 202 defines a plane of symmetry S of the cylinder liner member 202 and the wall 206 further defines a fourth bore 224 that is symmetrical to the first bore 214 about the plane of symmetry S, a fifth bore 226 that is symmetrical to the second bore 216 about the plane of symmetry S and a sixth bore 228 that is symmetrical to the third bore 218 about the plane of symmetry S.

Figure 7:
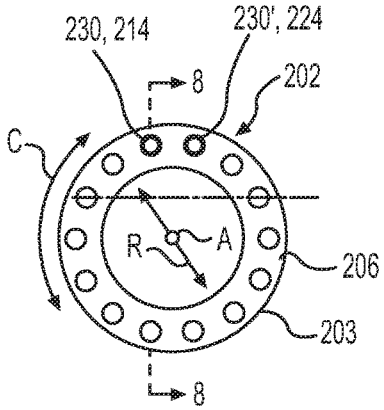
FIG. 7 is a right end view of the cylinder liner of FIG. 6.
Figure 11:
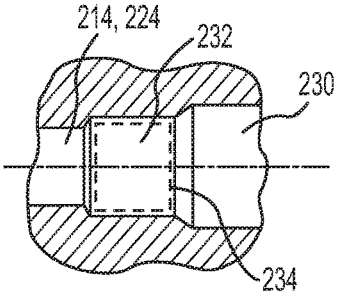
FIG. 11 is an enlarged detail view of the area designated 11 in FIG. 8.

FIGS. 7 and 11 illustrate how the first and fourth bores 214, 224 are drilled and plugged and then how the head cap 114 is then fastened onto cylinder liner member 202. A circular array of conventionally tapped holes 230 is provided along the first end 203 of the cylinder liner member 202. As shown in FIG. 7, fourteen of these holes 230 are provided that are evenly spaced. The top two instances of these holes 230 are concentric with the first and fourth bored holes 214, 224. As shown in FIG. 11, the first and fourth bored holes 214, 224 are drilled first. Then a pipe tap portion 232 into which a plug 234 may be insert is machined. Finally, the tapped hole 230 is formed. So, the assembler may plug the first and fourth holes, preventing any fluid leakage. Then, the head cap may be fastened using all fourteen conventionally tapped holes (see FIG. 1). The depth of the tapped holes and the length of fasteners used are chosen so no interference occurs between a plug and a fastener so proper fastening of the head cap may be achieved completely around the circumference of the cylinder liner member. In some embodiments, the plug may be inserted farther into the first and fourth bores before their intersection with the third and sixth bores respectively.

Figure 12:
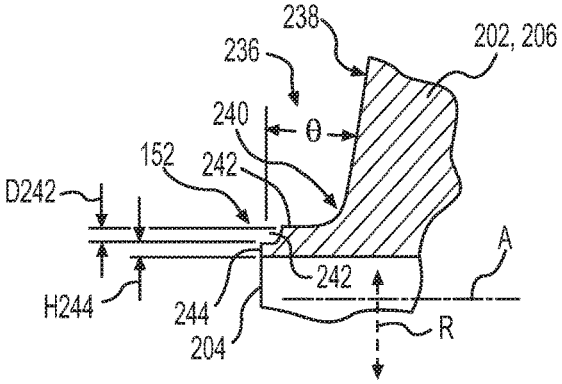
FIG. 12 is an enlarged detail view of the area designated 12 in FIG. 9.

FIG. 12 illustrates how the stepped interface 152 (see FIG. 3) is formed between rear end 204 of the cylinder liner 202 and the rear cap 150. While FIG. 12 does not show the rear cap, it is to be understood that the rear cap has a similar complimentarily and symmetrically shaped geometry as that shown in FIG. 12. A weld seam 236 is formed at the rear end 204 of the cylinder liner 202, that includes an angled wall 238 that leads to a blend 240 that leads to a flat 242 and then to the stepped interface 152. The stepped interface 152 includes a notch 242 have a radial depth D242 and a ledge 244 having a radial height H244. The blend may have a radius of approximately 6 mm and the wall form an angle θ of 10 degrees with the radial direction. The D242 may range from 2-4 mm and H244 may also range from 2-4 mm. Again, any of these dimensions or angles may be varied as needed or desired. When the ledge of the cylinder liner is inserted into the notch of the rear cap, and when the ledge of the rear cap is inserted into the notch of the cylinder liner, radial movement of the cylinder liner relative to the rear cap and vice versa is prevented. Then, the two parts are welded together as best seen in FIG. 3, preventing any axial movement between the two components.

It is also possible to manufacture the cylinder liner from solid bar material. This would eliminate the need to weld a rear cap onto the cylinder liner. In other embodiments, it may be possible to bolt the rear cap onto the cylinder liner. However, this may be difficult to do in some applications because the fasteners may interfere with the bores conveying the fluid.

Now, specific details of the hydraulic manifold according to an embodiment of the present disclosure will be discussed. Details of the hydraulic manifold are most clearly understood looking at FIGS. 3, 5, 14 and 15. A hydraulic manifold assembly 300 according to an embodiment of the present disclosure may include at least a main member 302 defining a top surface 304, a bottom surface 306 and a thickness T between the top surface 304 and the bottom surface 306 being the minimum dimension of the main member 302. The main member 302 may further define a first plurality of channels including a first channel 308 extending in a direction perpendicular to the thickness T of the main member 302 and a second channel 310 in communication with the first channel 308 extending in a direction parallel to the thickness T. Similarly, the main member 302 may further define a second plurality of channels including a third channel 312 extending in a direction perpendicular to the thickness T of the main member 302 and a fourth channel 314 extending in a direction parallel to the thickness T. The first and second plurality of channels are not in communication with each other and are spaced apart from each other along a direction that is perpendicular to the thickness (e.g. axial direction of the cylinder liner member) of the main member a distance D302.

For this embodiment, the thickness of the main member is in a direction parallel to the radial direction of the cylinder liner member. Similarly, the directions perpendicular to the thickness direction are tangential to the circumferential direction of cylinder liner member or parallel with the axial direction. This may not be the case in other embodiments.

The second channel 310 and fourth channel 314 exit the bottom surface 306 of the main member 302, allowing fluid to be communicated to the extend and retract volumes 126, 128 of the cylinder assembly 100 in a manner previously described herein. The manifold assembly 300 also includes a first channel insert 316 that defines a fifth channel 318 that is aligned with the fourth channel 314 of the main member 302. The main member 302 also defines an aperture 320 extending from the top surface 304 to the bottom surface 306 and the assembly 300 further comprises a second channel insert 322 that is disposed in the aperture 320. The second channel insert 322 defines the first and second channels 308, 310.

The manifold assembly may further comprise a top plate 324 attached to the main member 302, at least partially retaining the second channel insert 322 in place. As shown, the top plate 324 is fastened onto the main member but other forms of attachment are possible. A lower plate 326 is also provided that is welded onto the cylinder liner member and that partially houses the second channel insert as well. Other configurations and constructions of the manifold assembly are possible. Focusing on FIG. 5, seals 328 may be provided to prevent leaking between the second channel insert 322 and the components around it. A similar arrangement may be used in conjunction with the first channel insert.

Figure 14:
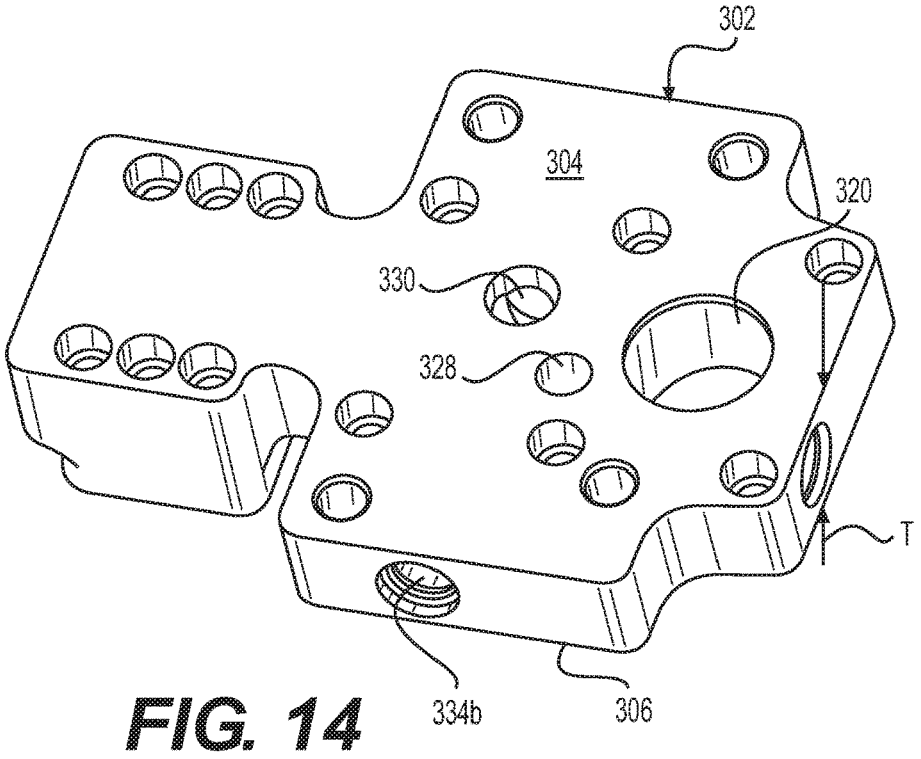
FIG. 14 is a perspective view of the hydraulic manifold of FIGS. 3 and 5 shown in isolation from the hydraulic cylinder assembly.
Figure 15:
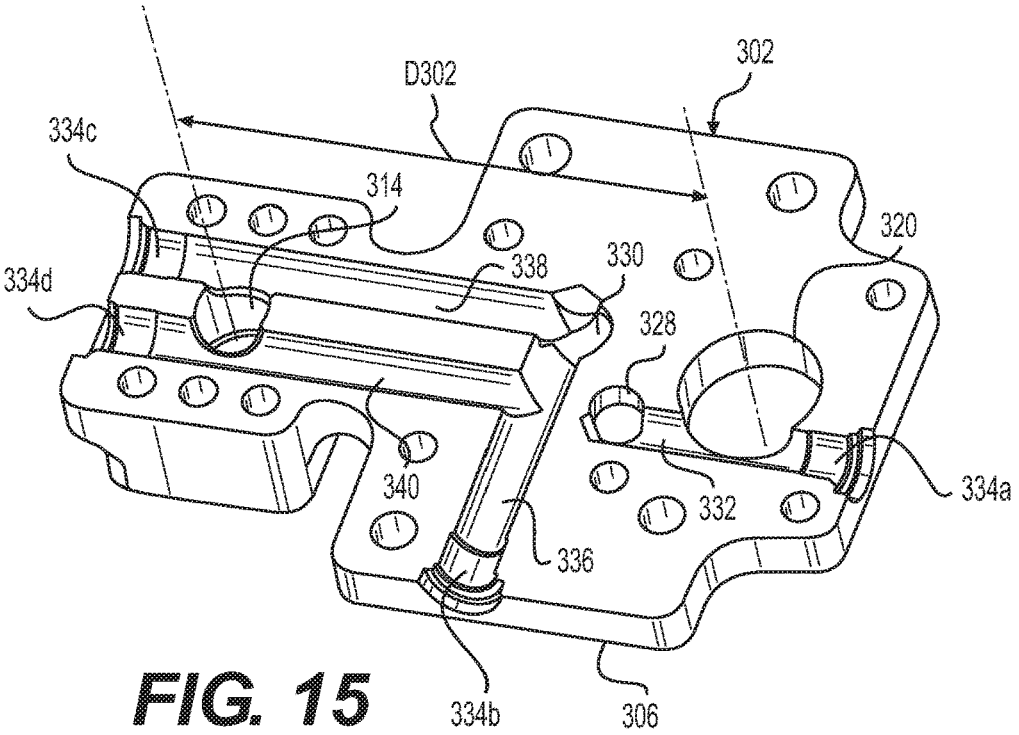
FIG. 15 is a cross-sectional view of the hydraulic manifold of FIG. 14 taken along a midplane located midway through the thickness of the manifold.

Referring now only to FIGS. 14 and 15, additional details of the manifold main member 302 are illustrated. It is to be understood that the top plate 324 is used to limit contamination and to prevent damage to the mounting surface for the valve assembly. As will be shown later herein, a valve assembly is attached to the top surface 304 of the main member 302 to which hoses are connected for supplying the hydraulic fluid. The main member 302 of the manifold assembly 300 defines a first inlet channel 328 extending from the top surface 304 of the main member 302 to the first plurality of channels. Similarly, the main member 302 also defines a second inlet channel 330 extending from the top surface 304 of the main member 302 to the second plurality of channels.

The first plurality of channels includes a cross-bore 332 extending in a direction parallel to the axial direction of the cylinder that is in communication with aperture 320. This cross-bore 332 includes a plugged end 334. Also, the second plurality of channels include a first cross-bore 336 that is in communication with the second inlet channel 330 wherein the first cross-bore 336 extends in a direction that is tangential to the circumferential direction of the hydraulic cylinder. This first cross-bore 336 is in communication with a second and a third cross-bore 338, 340 that extend in the axial direction of the hydraulic cylinder and are in communication with aperture 314. The first, second and third cross-bores 336, 338, 340 also have plugged ends 334. Consequently, any fluid that enters through an inlet channel is conveyed to the retract or extend side of the hydraulic cylinder assembly as desired through the manifold 300.

INDUSTRIAL APPLICABILITY

In practice, a hydraulic cylinder assembly, cylinder liner assembly, cylinder liner member, hydraulic manifold for use with a cylinder, or any components or subassemblies according to any of the embodiments as discussed herein may be manufactured, sold or attached to a machine as described herein. This may be done in an aftermarket or OEM context, that is to say, the assembly, manifold, subassembly or component may be sold originally with a machine or be attached to the machine later after the original purchase of the machine. Similarly, a machine may originally be equipped or configured to use any of the embodiments of hydraulic cylinder assembly, cylinder liner assembly, cylinder liner member, hydraulic manifold, etc. as described herein or be retrofitted with the ability to use such assemblies, subassemblies, or components. Any of the components may be made using any suitable material such as steel, etc.

Figure 13:
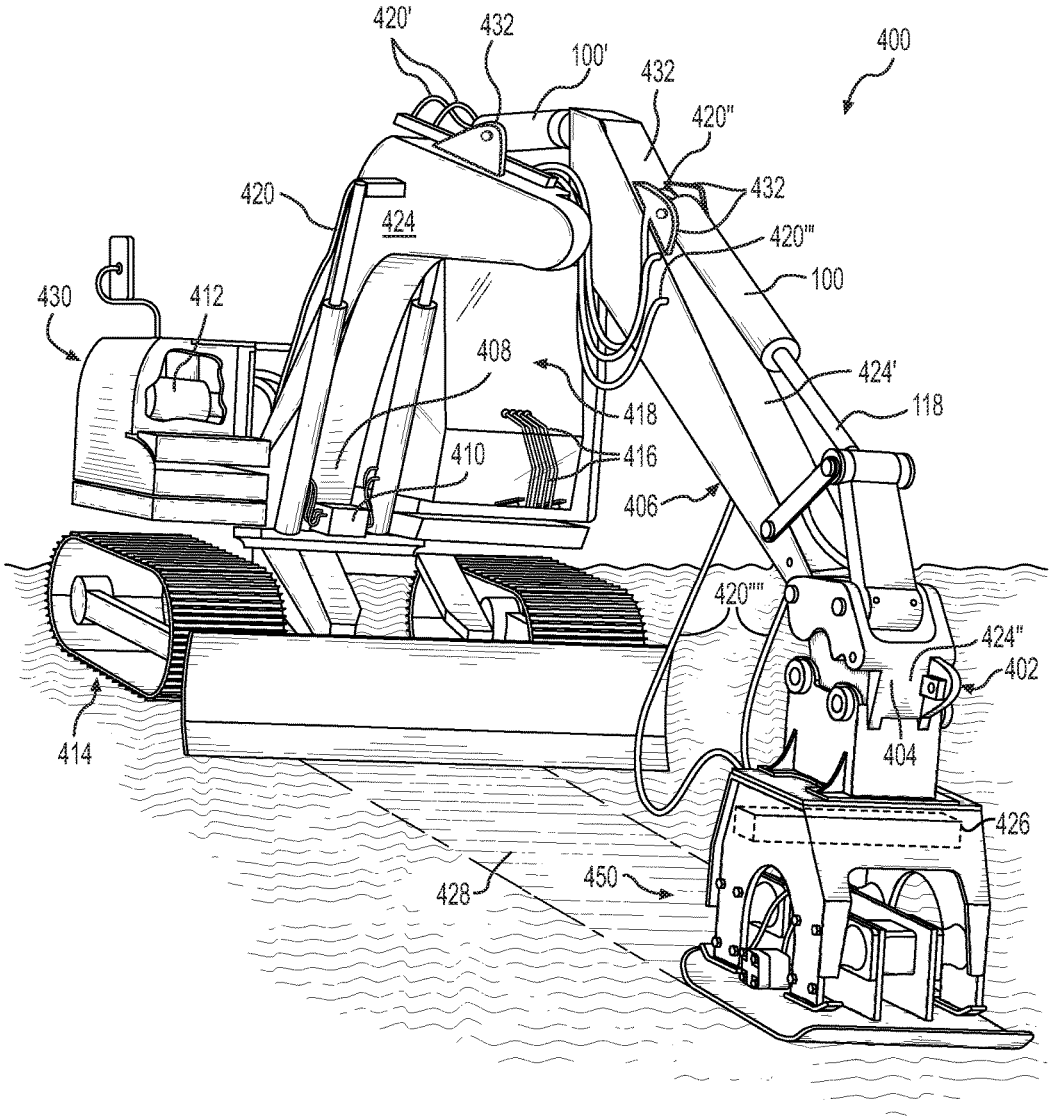
FIG. 13 illustrates a machine that may employ various embodiments of a hydraulic cylinder assembly, cylinder liner assembly, cylinder liner member, hydraulic manifold assembly, or components of any of these subassemblies or assemblies.

Looking now at FIG. 13, a perspective view is shown of a machine 400 using a hydraulic cylinder assembly 100 according to an embodiment of the present disclosure to compact soil 428. The machine 400 has a coupling device 402 to attach a vibratory plate compactor assembly 450 to the machine and be controlled by the machine 400. Other work implements may be used such as a bucket, hydraulic hammer, etc. In this embodiment, the coupling device 402 is located at the free end 404 of the boom 406 opposite the end 408 of the boom 406 that is attached to the turn table 430 of the machine 400. The machine 400 further comprises a controller 410, a motor 412, a wheel or track undercarriage 414 that is driven by the motor 412, and the vibratory plate compactor assembly 450 that is attached to the boom 406 of the machine 400 using the coupling device 402 as already mentioned. The controller 410 is in communication or operative association with the controls 416 provided in the cab 418 so that the operator may control the movement and function of various parts and systems of the machine 400.

More specifically, the machine 400 depicted in FIG. 13 is a large excavator but it is contemplated that other machines such as backhoes and the like could also use a hydraulic cylinder assembly 100 according to any embodiment of the present disclosure. Furthermore, the machine 400 is mobile on a track driven undercarriage 414 but a more conventional wheel or tire type undercarriage may also be used that is powered by the motor 412. For this machine 400, the motor 412 comprises an internal combustion engine but other motors such as an electric motor could be used for other embodiments. In addition, hydraulic hoses 420 connect the cylinders 200 that move the linkage members 424 of the boom 406 to a compactor hydraulic manifold 426. A hydraulic pump (not shown) provides the hydraulic fluid necessary to power the hydraulic cylinder assemblies 100.

As mentioned previously with respect to FIG. 1 thru 3, the first and second sleeve bearings 148, 148' face in diametrically opposite directions and are configured to be received in orifices of structural members 432 attached to the machine 400 such that the assembly 100 may rotate about an axis of rotation A148 defined by the external sleeve bearings 148 relative to the machine 400 as the cylinder rod 118 extends and retracts.

Figure 16:
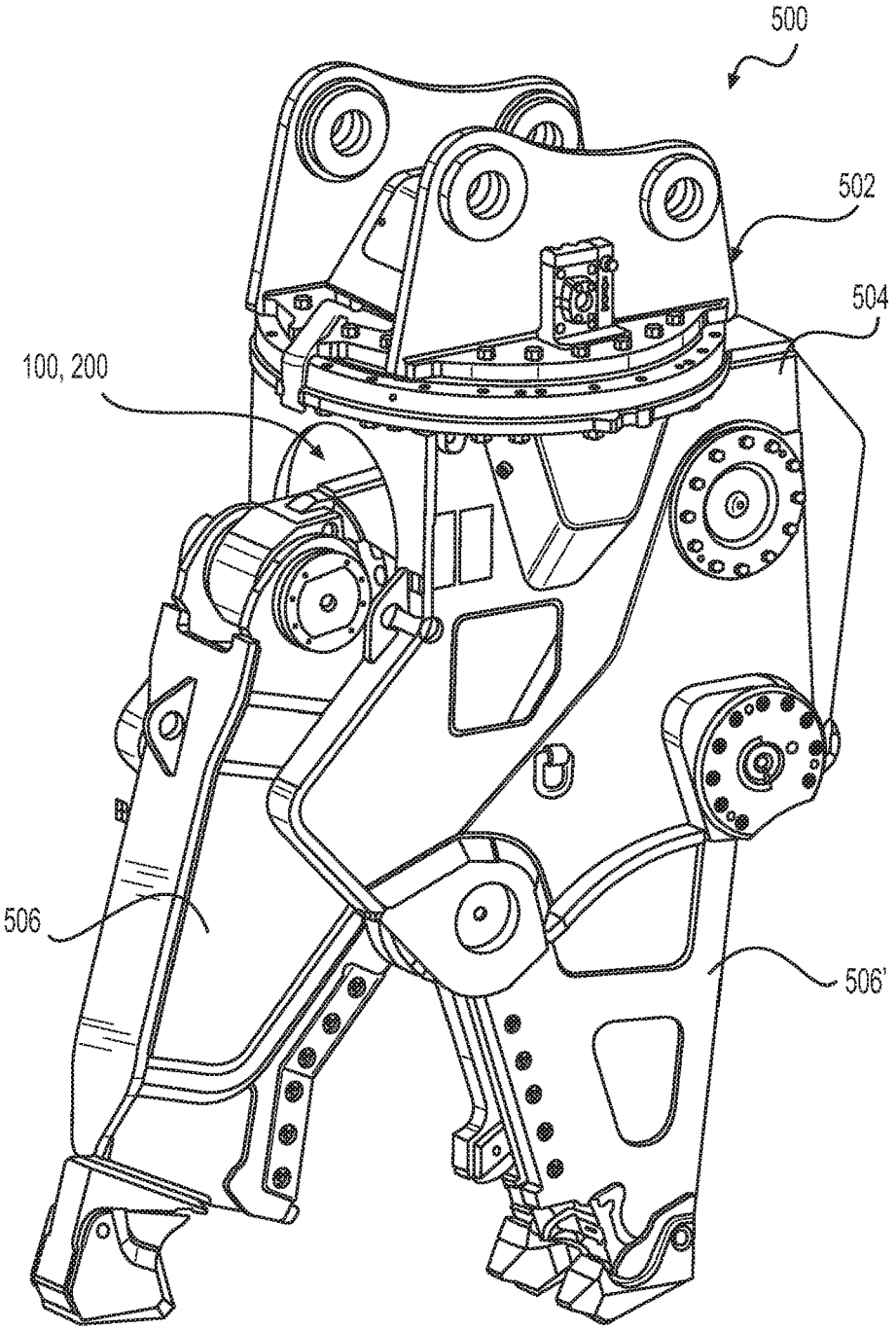
FIG. 16 is a perspective of a work tool in the form of shears that are powered by a hydraulic cylinder assembly according to an embodiment of the present disclosure.
Figure 17:
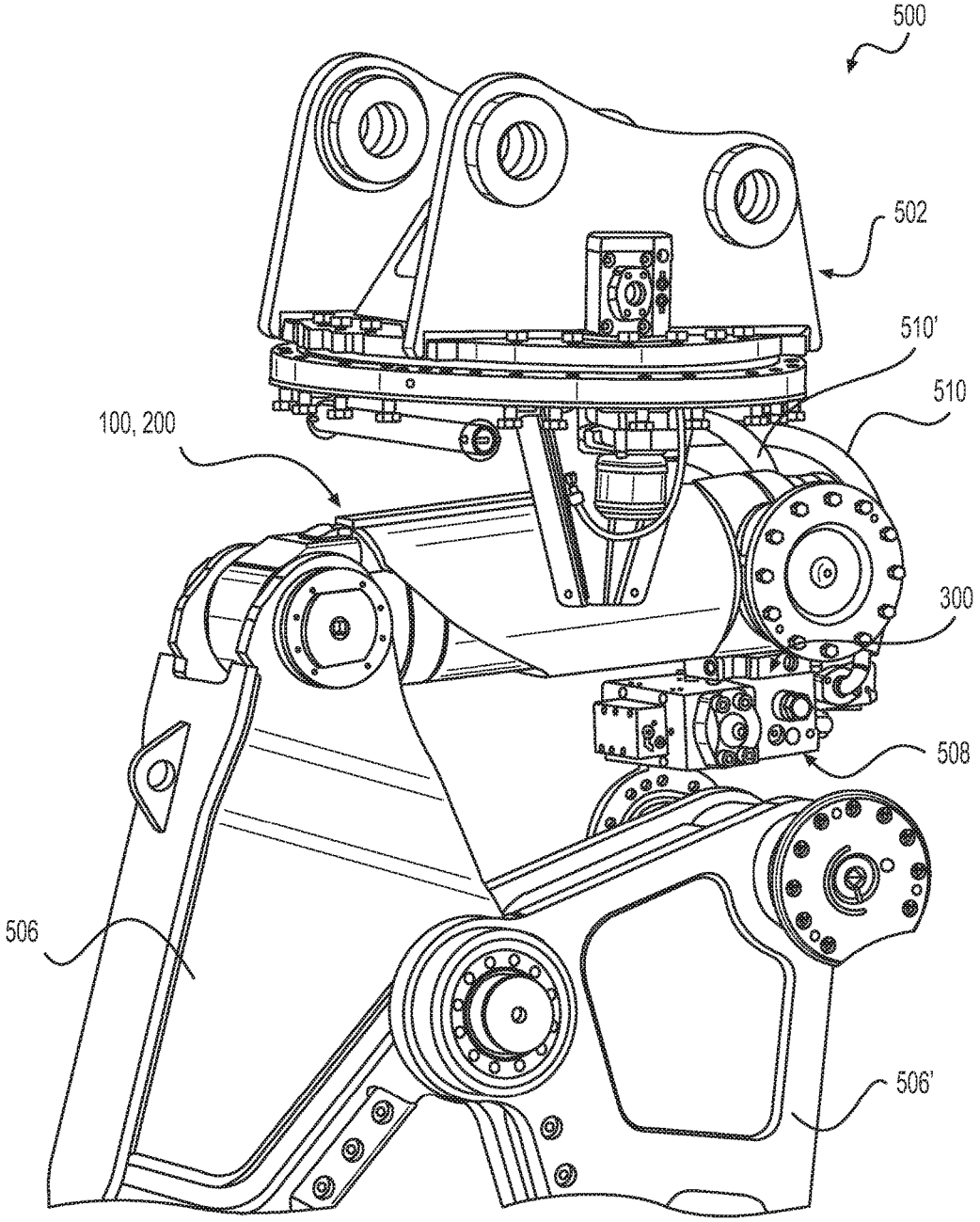
FIG. 17 is an enlarged perspective view of the work tool of FIG. 16 with the yoke member of the shears removed, revealing the hydraulic cylinder, hydraulic manifold, valve assembly and hoses feeding fluid to these components more clearly.
Figure 18:
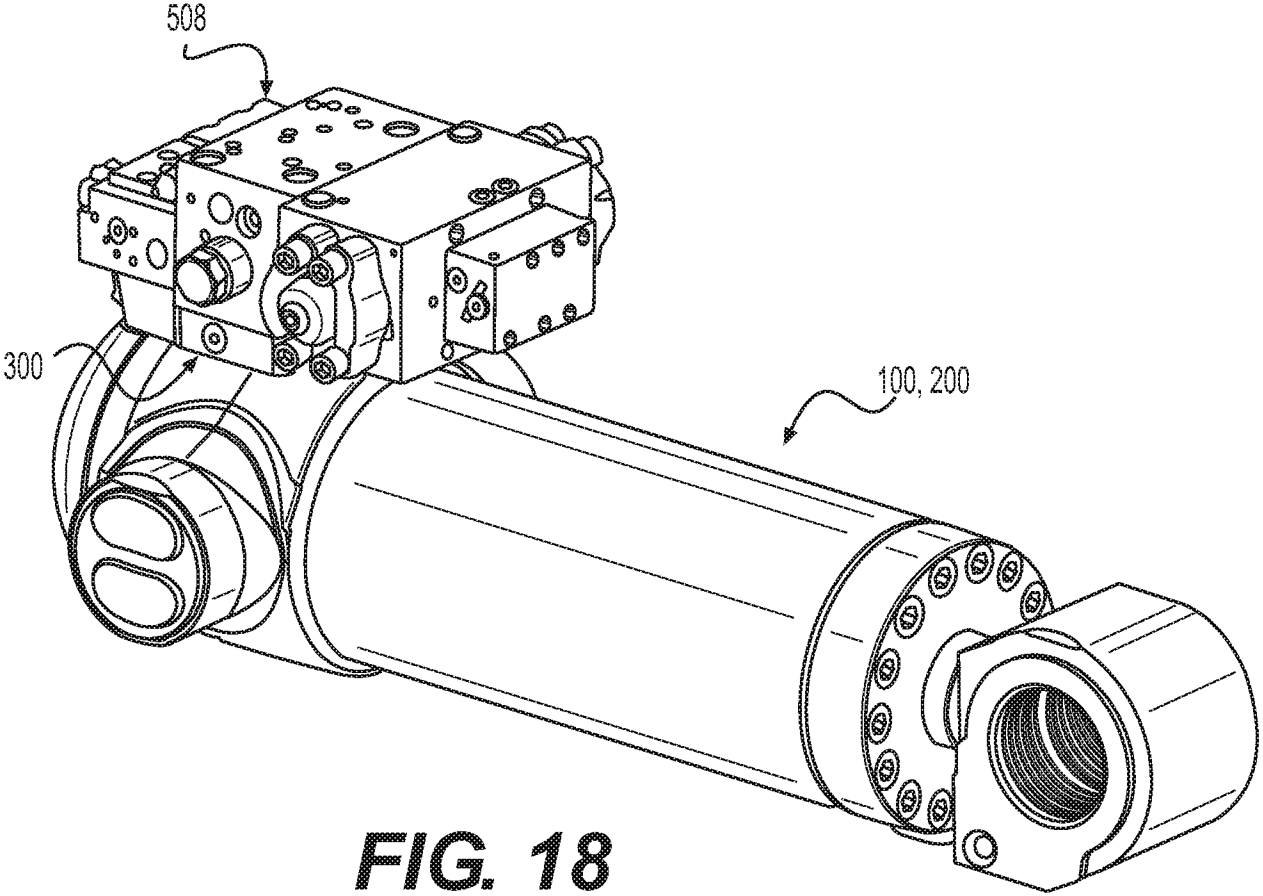
FIG. 18 is a perspective view of the hydraulic cylinder, valve assembly, and hydraulic manifold assembly removed from the work tool of FIG. 17.

Another application of a hydraulic cylinder assembly 100 as described herein is shown with reference to FIG. 16 thru 18. As shown in FIG. 16, a hydraulic cylinder assembly 100 may be used to power movement of a work tool 500 such as shears. The work tool 500 is attached to a machine using an adapter subassembly 502 that is rotatably connected to a yoke member 504 to which two jaw members 506 are rotationally attached. As the cylinder assembly 100 expands, the jaws 506 close and the shears pinch a work piece. As the cylinder assembly 100 contracts, the jaws 506 open.

Focusing now on FIGS. 17 and 18, it can be appreciated how the cylinder assembly 100, the manifold assembly 300 and valve assembly 508 work together. Hoses 510 feed the valve assembly 508 with fluid supplied from the machine to which the work tool 500 is attached. The valve assembly 508 includes a spool valve (not shown) or the like that controls which portion of the manifold assembly 300, and therefore, which side of the hydraulic cylinder assembly 100, the extend or retract side, receives the fluid and which side expels the fluid. Accordingly, another set of hoses to feed the retract side of the hydraulic cylinder assembly is no longer needed, helping to prevent hose damage proximate the moving jaws 506, obstacles or work pieces intended to be pinched, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A cylinder liner member comprising:

a generally cylindrical annular wall defining a cylindrical axis, a radial direction, a circumferential direction, a first end and a second end disposed along the cylindrical axis defining a length therebetween, and an interior space partially enclosed by the wall and extending from the first end to the second end, forming first and second openings at the first and second ends respectively;

wherein the wall defines a first axially extending bore that extends from either the first end or the second end along most of the length of the cylinder liner member, a second bore extending at least partially radially, and a third bore extending at least partially radially; and wherein the first, second and third bores are in communication with each other and the second bore extends from an outer cylindrical surface of the wall and intersects the first bore and the third bore extends from an inner cylindrical surface of the wall and intersects the first bore;

the first intersection of the first bore and the second bore is spaced a predetermined distance away from the second intersection of the first bore and the third bore along the cylindrical axis, wherein the distance is greater than half the length of the cylinder liner member;

the second bore extends both radially and circumferentially and the third bore extends both radially and axially and the second bore is disposed nearest the second end along the cylindrical axis and the third bore is disposed nearest the first end along the cylindrical axis;

the wall defines an axial plane and the second bore extends in a direction that forms an angle in the axial plane with respect to the radial direction that ranges from 40 to 50 degrees, and wherein the wall defines a radial plane and the third bore extends in a direction that forms an angle in the radial plane with respect to the radial direction that ranges from 40 to 50 degrees, wherein the direction the third bore extends intersects the first opening; and the cylinder liner member includes a plane of symmetry of the cylinder liner member and the wall further defines a fourth bore that is symmetrical to the first bore about the plane of symmetry, a fifth bore that is symmetrical to the second bore about the plane of symmetry and a sixth bore that is symmetrical to the third bore about the plane of symmetry.

2. A hydraulic manifold assembly comprising:

at least a main member defining a top surface, a bottom surface and a thickness between the top surface and the bottom surface being the minimum dimension of the main member, the main member further defining a first plurality of channels including a first channel extending in a direction perpendicular to the thickness of the main member and a second channel in communication with the first channel extending in a direction parallel to the thickness;

a second plurality of channels including a third channel extending in a direction perpendicular to the thickness of the main member and a fourth channel extending in a direction parallel to the thickness;

wherein the first and second plurality of channels are not in communication with each other and are spaced apart from each other along a direction that is perpendicular to the thickness of the main member:

the second channel and fourth channel exit the bottom surface of the main member;

the hydraulic manifold assembly further comprising a first channel insert that defines a fifth channel that is aligned with the third channel of the main member;

the main member defines an aperture extending from the top surface to the bottom surface and the assembly further comprises a second channel insert that is disposed in the aperture, the second channel insert defining the first and second channels;

the hydraulic manifold further comprising a top plate attached to the main member, at least partially retaining the second channel insert in place.

* * * * *